US006180263B1

(12) United States Patent
Naoi

(10) Patent No.: US 6,180,263 B1
(45) **Date of Patent: *Jan. 30, 2001**

(54) HARD CARBON COATING-CLAD BASE MATERIAL

(75) Inventor: Koichi Naoi, Kawagoe (JP)

(73) Assignee: Citizen Watch Co., Ltd., Tokyo (JP)

( * ) Notice: Under 35 U.S.C. 154(b), the term of this patent shall be extended for 0 days.

This patent is subject to a terminal disclaimer.

(21) Appl. No.: 09/024,075

(22) Filed: Feb. 17, 1998

Related U.S. Application Data

(62) Division of application No. 08/786,849, filed on Jan. 22, 1997, now Pat. No. 6,074,766, which is a division of application No. 08/171,659, filed on Dec. 21, 1993, now Pat. No. 5,607,779.

(30) Foreign Application Priority Data

Dec. 22, 1992 (JP) ..... 4-92187
Nov. 16, 1993 (JP) ..... 5-61587

(51) Int. Cl.[7] ..... B32B 15/04

(52) U.S. Cl. ..... 428/634; 428/641; 428/660; 428/667; 428/670; 428/679

(58) Field of Search ..... 428/634, 622, 428/615, 667, 441, 660, 661, 621, 680, 681, 670, 641, 684

(56) References Cited

U.S. PATENT DOCUMENTS

| | | | |
|---|---|---|---|
| 1,792,082 | 2/1931 | Fink et al. | 428/667 |
| 2,908,966 | 10/1959 | Wagner | 428/660 |
| 3,125,805 | 3/1964 | Horigan, Jr. | 428/667 |
| 3,795,494 | 3/1974 | Hordon | 428/660 |
| 4,358,922 | 11/1982 | Feldstein | 428/634 |
| 4,655,884 | 4/1987 | Hills et al. | 204/181 |
| 4,761,346 | 8/1988 | Naik | 428/660 |
| 5,538,799 * | 7/1996 | Nanya | 428/626 |
| 5,607,779 * | 3/1997 | Naoi | 428/634 |

FOREIGN PATENT DOCUMENTS

| | | |
|---|---|---|
| 0188057 | 7/1986 | (EP) . |
| 0311847 | 4/1989 | (EP) . |
| 2682399 | 4/1993 | (FR) . |
| 62-116767 | 5/1987 | (JP) . |
| 63-262467 | 10/1988 | (JP) . |
| 2149673 | 6/1990 | (JP) . |

* cited by examiner

*Primary Examiner*—John J. Zimmerman
(74) *Attorney, Agent, or Firm*—Webb Ziesenheim Logsdon Orkin & Hanson, P.C.

(57) ABSTRACT

The hard carbon coating-clad base material of the present invention comprises a base material, a substratal metal coating formed on the base material by a wet plating process, an intermediate metal coating comprising a titanium or chromium coating formed on the substratal metal coating by a dry plating process and a silicon coating formed on the titanium or chromium coating by a dry plating process, and a hard carbon coating formed on the silicon coating by a dry plating process. According to the present invention, a highly reliable hard carbon coating which is excellent in corrosion resistance, adhesion and abrasion resistance can be formed even on brass or an iron base material having poor corrosion resistance, such as SK steel and martensitic and ferritic stainless steels.

2 Claims, 2 Drawing Sheets

HARD CARBON COATING-CLAD BASE MATERIAL

This is a divisional of application Ser. No. 08/786,849 filed on Jan. 22, 1997, now U.S. Pat. No. 6,074,766, which is a divisional of application Ser. No. 08/171,659 filed on Dec. 21, 1993, now U.S. Pat. No. 5,607,779.

FIELD OF THE INVENTION

The present invention relates to a hard carbon coating-clad base material. More particularly, the present invention relates to a hard carbon coating-clad base material in which an intermediate layer is provided between the base material and a hard carbon coating to thereby improve the adhesion with the hard carbon coating and the corrosion resistance.

BACKGROUND OF THE INVENTION

In recent years, the hard carbon coating is attracting attention because it has excellent properties, e.g., high hardness, high insulation, high thermal conductivity and chemical stability, similar to those of diamond. For the formation of the hard carbon coating, already, the physical vapor deposition method (hereinafter referred to as "PVD"), such as the ion beam method, the sputtering method and the ion plating method, the ECR (Electron Cyclotron Resonance) and the RF (Radio Frecuency) plasma chemical-vapor deposition method (hereinafter referred to as "RFP-CVD") have been brought into practical use.

Generally, a compressive stress as high as about $10^{10}$ dyne/cm$^2$ remains in the hard carbon coatings formed by the above methods. Therefore, the base material provided with the hard carbon coating formed by any of the above methods has such drawbacks that the adhesion between the hard carbon coating and the base material, especially when the base material is composed of a metal, is so poor that peeling or cracking is caused to shorten its life, or the formation of the hard carbon coating on the base material is infeasible. That is, although the hard carbon coating can be formed on the surface of a silicon base material or a super hard material by any of the above methods, it is difficult to form the hard carbon coating on the surface of any of various metal base materials, such as stainless steel base materials. Therefore, the problem exists that the types of the base materials on which the hard carbon coating can be formed are very limited.

In Japanese Patent Laid-Open Publication No. 116767/1987 (Japanese Patent Application No. 256426/1985), the inventors proposed a hard carbon coating-clad base material in which an intermediate layer composed of a lower layer mainly composed of chromium or titanium, formed on the surface of a base material by a dry plating process, and an upper layer mainly composed of silicon or germanium, formed on the surface of the lower layer by a dry plating process, is disposed between a metal base material and the hard carbon coating. Further, the inventors also proposed in Japanese Patent Laid-Open Publication No. 149673/1990 (Japanese Patent Application No. 301829/1988) a hard carbon coating-clad base material in which a solid solution layer is formed at the interface of the above upper and lower layers constituting the intermediate layer by counter diffusion.

However, still in the hard carbon coating-clad base material proposed in Japanese Patent Laid-Open Publication No. 149673/1990, the types of the base materials on which the hard carbon coating can be formed are limited. For example, when brass is employed as the base material, dezincing from the brass occurs in a vacuum atmosphere due to the rise in the temperature inside the chamber at the time of the formation of the above intermediate layer or the formation of the hard carbon coating, so that the surface of the brass base material turn into orange peel to thereby lower the corrosion resistance of the surface of the base material and the adhesion between the brass base material and the hard carbon coating. Therefore, the problem exists that, when brass is used as the base material of the hard carbon coating-clad base material proposed in Japanese Patent Laid-Open Publication No. 149673/1990, it is infeasible to fully utilize the excellent properties of the hard carbon coating.

Moreover, among iron materials Including a carbon Wool steel such as SK steel as defined in JIS G 4401 (1983), a martensitic stainless steel and ferritic stainless steel, when an iron material having poorer corrosion resistance than that of an austenitic stainless such as SUS 304 is used as the base material, corrosion due to rusting occurs in the base material after pre-wash to thereby cause the problem with respect to the adhesion between the base material and the hard carbon coating and the corrosion resistance of the hard carbon coating. The terminology "pre-wash" used herein means subjecting the base material to organic cleaning by using methylene chloride, etc., or subjecting the base material to alkaline degreasing cleaning by using alkali solution of 5–10%, and thereafter, to neutralization treatment by using nitric acid solution of 5–10%. In these pre-wash treatments, ultrasonic washer is jointly used.

OBJECT OF THE INVENTION

The object of the present invention is to obviate the above drawbacks of the prior art, in particular, to provide a highly reliable hard carbon coating-clad base material which is excellent in corrosion resistance, adhesion and abrasion resistance, even when brass or an iron material among iron materials including SK steel, a martensitic stainless steel and a ferritic stainless steel which has poorer corrosion resistance than that of an austenitc stainless steel is used.

SUMMARY OF THE INVENTION

A first aspect of hard carbon coating-clad base material of the present invention comprises:

- a base material,
- a substratal metal coating formed on the base material by a wet plating process,
- an intermediate metal coating comprising a titanium coating formed on the substratal metal coating by a dry plating process and a silicon coating formed on the titanium coating by a dry plating process, and
- a hard carbon coating formed on the silicon coating by a dry plating process.

Further, a second aspect of hard carbon coating-clad base material of the present invention comprises:

- a base material,
- a substratal metal coating formed on the base material by a wet plating process,
- an intermediate metal coating comprising a chromium coating formed on the substratal metal coating by a dry plating process and a silicon coating formed on the chromium coating by a dry plating process, and
- a hard carbon coating formed on the silicon coating by a dry plating process.

DETAILED DESCRIPTION OF THE INVENTION

Figure 1:
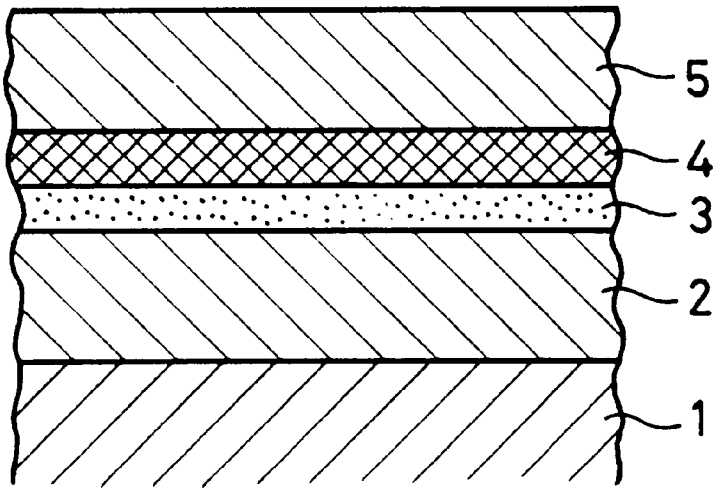
FIG. 1 is a view showing a cross section of an essential portion of a preferred feature of the hard carbon coating-clad base material according to the present invention.

Hereinbelow, the hard carbon coating-clad base material according to the present invention will be explained in greater detail.

The hard carbon coating-clad base material according to a first aspect of the present invention comprises:

a base material, a substratal metal coating formed on the base material by a wet plating process, an intermediate metal coating comprising a titanium coating formed on the substratal metal coating by a dry plating process and a silicon coating formed on the titanium coating by a dry plating process, and a hard carbon coating formed on the silicon coating by a dry plating process.

Further, the hard carbon coating-clad base material according to a second aspect of the present invention comprises:

a base material, a substratal metal coating formed on the base material by a wet plating process, an intermediate metal coating comprising a chromium coating formed on the substratal metal coating by a dry plating process and a silicon coating formed on the chromium coating by a dry plating process, and a hard carbon coating formed on the silicon coating by a dry plating process.

As the above base material, metal materials having poor corrosion resistance may be mentioned which include, for example, brass, SK steel, a martensitic stainless steel and a ferritic stainless steel.

The above substratal metal coating is preferably at least one coating selected from the group consisting of a nickel alloy coating, a nickel coating, a chromium coating, a palladium coating, a combination of a nickel alloy coating and a chromium coating, and a combination of a nickel alloy coating and a palladium coating.

This substratal metal coating is formed on the above base material by a wet plating process. In particular, the substratal metal coating can be formed on the base material by the use of a plating bath containing ions of the metal for composing the substratal coating.

Examples of nickel alloy coatings include a nickel-phosphorus alloy coating, a nickel-palladium alloy coating, a nickel-boron alloy coating, and a nickel-tin alloy coating.

Formation of the palladium coating on the base material is suitable when a base material having poor corrosion resistance, such as a copper alloy material is used. Formation of the chromium coating on the base material is suitable when a base material requiring abrasion resistance is used. However, when chromium plating cannot be performed for the problem, such as waste water treatment, the nickel coating may be applied by the use of nickel plating. Further, when the hard carbon coating-clad base material is utilized under conditions such that corrosion resistance is requisite, it is feasible to attain further improvement of corrosion resistance by forming the palladium coating on the nickel alloy coating. Still further, when both high hardness and abrasion resistance are required, a hard carbon coating-clad base material having the required high hardness and abrasion resistance can be produced with relatively low cost by forming the chromium coating on the nickel alloy coating. Still further, when all of high hardness, abrasion resistance and corrosion resistance are required, it is preferred that the chromium coating be formed on the nickel alloy coating and then the palladium coating be formed on the chromium coating.

In the present invention, the corrosion resistance of a base material, such as those of brass, SK steel, a martensitic stainless steel and a ferritic stainless steel, is improved by directly forming the above substratal metal coating on the base material. Further, when the substratal metal coating is subjected to an aging treatment, the hardness of the substratal metal coating is increased to thereby attain further utilization of the characteristics of the hard carbon coating.

In the present invention, the titanium coating is formed on the above substratal metal coating by a dry plating process. Subsequently, the silicon coating is formed on the titanium coating by a dry plating process to thereby form the intermediate metal coating composed of the titanium coating and the silicon coating.

Further, in the present invention, the intermediate metal coating composed of the chromium coating and the silicon coating can be formed by forming the chromium coating on the above substratal metal coating according to a dry plating process and then forming the silicon coating on the chromium coating according to a dry plating process.

These intermediate metal coatings are formed by the dry plating process, which is, for example, PVD, such as the ion beam process, the sputtering process and the ion plating process, ECR or RF-CVD.

That is, the above two-layer intermediate metal coatings are individually composed of the titanium or chromium coating formed on the above substratal metal coating by a dry plating process and the silicon coating formed on the titanium or chromium coating by a dry plating process.

Further, in the present invention, either the intermediate metal coating composed of successive layers of the titanium, chromium and silicon coatings can be formed by successively superimposing the titanium, chromium and silicon coatings on the substratal metal coating according to a dry plating process, or the intermediate metal coating composed of successive layers of the chromium, titanium and silicon coatings can be formed by successively superimposing the chromium, titanium and silicon coatings on the substratal metal coating according to a dry plating process.

By virtue of the above intermediate metal coatings, the hard carbon coating can be effectively formed on a metal base material, and, especially, the hard carbon coating having excellent corrosion resistance, abrasion resistance and adhesion can be formed on a metal base material having poor corrosion resistance.

In the present invention, the hard carbon coating is formed on the silicon coating which is an upper layer of the above intermediate metal coating by a dry plating process.

The formation of the hard carbon coating on the intermediate metal coating can be carried out by the same dry plating process as employed in the formation of the intermediate metal coating.

The hard carbon coating-clad base material having excellent corrosion resistance, abrasion resistance and adhesion can be obtained by the above formation of the hard carbon coating.

Hereinbelow, examples of hard carbon coating-clad base materials according to the present invention will be described in greater detail, referring to the drawings.

FIG. 1 is a view showing a cross section of an essential portion of a preferred feature of the hard carbon coating-clad base material according to the present invention. As shown in FIG. 1, the hard carbon coating-clad base material comprises a base material 1 having poor corrosion resistance, a substratal metal coating of a nickel alloy coating 2 formed on the base material 1 by a wet plating process, a two-layer intermediate metal coating composed of a titanium coating 3 formed on the nickel alloy coating 2 by a dry plating process and a silicon coating 4 formed on the titanium coating 3 by a dry plating process, and a hard carbon coating 5.

Examples of suitable base materials 1 having poor corrosion resistance include brass; a carbon tool steel, such as SK steel; a martensitic stainless steel and a ferritic stainless steel.

For example, a substratal metal coating of a nickel-phosphorus alloy coating having a thickness of 0.5 to 5 μm is formed on a base material of SK steel by a wet plating process, preferably a nickel plating process, for instance, an electroless nickel-phosphorus plating process. The wet plating is preferably performed in a plating bath having the following composition under the following plating conditions.

| [Nickel-phosphorus alloy plating] | |
|---|---|
| {Composition of plating bath} | |
| nickel sulfate | 20 g/liter |
| sodium hypophosphite | 25 g/liter |
| lactic acid | 25 g/liter |
| propionic acid | 3 g/liter |
| {Plating conditions} | |
| pH | 4–5 |
| temperature | 90° C. |

After the above formation of the nickel-phosphorus alloy coating on the base material of SK steel, an aging treatment may be performed. The aging treatment is generally performed at 400 to 500° C. for 30 to 60 min. In place of the above nickel-phosphorus alloy coating, a nickel-boron alloy coating may be formed by an electroless nickel-boron plating process. This plating is preferably performed in a plating bath having the following composition under the following plating conditions.

| [Nickel-boron alloy plating] | |
|---|---|
| {Composition of plating bath} | |
| nickel chloride | 30 g/liter |
| sodium hydroxide | 40 g/liter |
| ethylenediamine | 60 g/liter |
| sodium fluoride | 3 g/liter |
| sodium borohydride | 0.5 g/liter |
| {Plating conditions} | |
| temperature | 90° C. |

As other nickel alloy coatings 2 than above, a nickel-palladium alloy coating and a nickel-tin alloy coating are available. These may individually be formed on the base material as a substratal metal coating. The formation of the nickel-palladium alloy coating and the nickel-tin alloy coating is generally performed by electrolytic plating.

Subsequently, a titanium coating 3 having a thickness of 0.1–0.5 μm is formed on the nickel-phosphorus alloy coating by a dry plating process, for instance, the sputtering process, and a silicon coating 4 having a thickness of 0.1–0.5 μm is similarly formed on the titanium coating 3, thereby forming a two-layer intermediate metal coating.

Thereafter, a hard carbon coating 5 having a thickness of 1.0–3.0 μm is formed on the above silicon coating 4 according to a dry plating process, e.g., the RFP-CVD process. The formation of the hard carbon coating 5 is preferably performed under the following conditions.

| [Hard carbon coating] | |
|---|---|
| {Conditions for coating formation} | |
| type of gas | methane gas |
| pressure for coating formation | 0.1 Torr |
| high frequency power | 300 watt |
| rate of coating formation | 0.12 μm/min |
| Vickers hardness (Hv) | 3,000–5,000 Nkgf/mm$^2$ |

Thus, a highly reliable hard carbon coating 5 which is excellent in corrosion resistance, adhesion and abrasion resistance is obtained on a base material 1 having poor corrosion resistance, such as SK steel.

Figure 2:
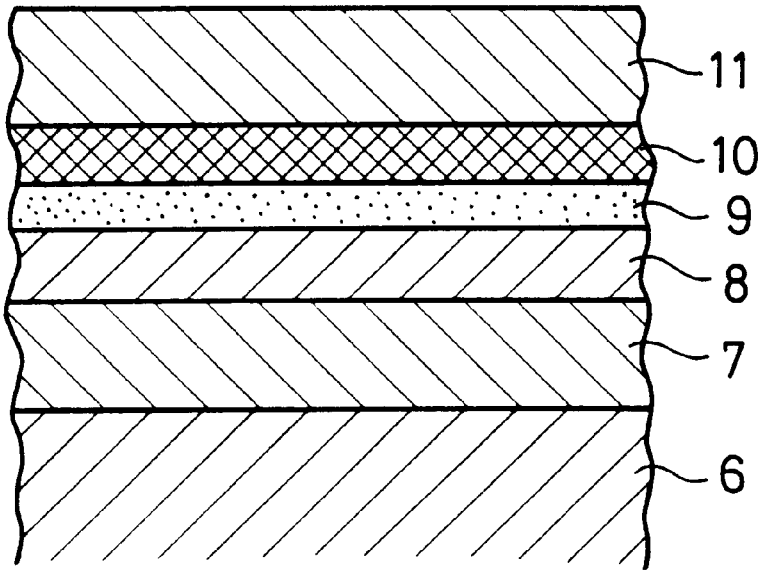
FIG. 2 is a view showing a cross section of an essential portion of another preferred feature of the hard carbon coating-clad base material according to the present invention.

FIG. 2 is a view showing a cross section of an essential portion of another preferred feature of the hard carbon coating-clad base material according to the present invention. As shown in FIG. 2, the hard carbon coating-clad base material comprises a base material 6 having poor corrosion resistance, a two-layer substratal metal coating composed of a nickel alloy coating 7 formed on the base material 6 by a wet plating process and a chromium coating 8 formed on the nickel alloy coating 7 by a wet plating process, a two-layer intermediate metal coating composed of a titanium coating 9 formed on the chromium coating 8 by a dry plating process and a silicon coating 10 formed on the titanium coating 9 by a dry plating process, and a hard carbon coating 11.

Examples of base materials 6 having poor corrosion resistance include those as set out above with respect to the hard carbon coating-clad base material shown in FIG. 1, such as brass and SK steel.

For example, a substratal metal coating of a nickel-phosphorus alloy coating having a thickness of 0.5 to 5 μm is formed on a base material of brass by the same wet plating process, preferably a nickel plating process, for instance, an electroless nickel-phosphorus plating process, as described above with respect to the hard carbon coating-clad base material shown in FIG. 1.

Subsequently, a chromium coating 8 having a thickness of 0.5 to 5 μm as another layer of the substratal metal coating is formed on the nickel-phosphorus alloy coating by a wet plating process. The wet plating is preferably performed in a plating bath having the following composition under the following plating conditions.

| [Chromium plating] | | |
|---|---|---|
| {Composition of plating bath} | | |
| chromic anhydride | 200–300 | g/liter |
| sulfuric acid | 2–3 | g/liter |
| trivalent chromium | 1–5 | g/liter |

-continued

| [Chromium plating] | |
|---|---|
| {Plating conditions} | |
| bath temperature | 40–55° C. |
| current density | 10–60 A/dm$^2$ |

Ornamental and industrial processes are available for chromium plating. Both can be utilized for the formation of the chromium coating 8.

Subsequently, a titanium coating 9 having a thickness of 0.1–0.5 μm is forced on the chromium coating 8 by a dry plating process, e.g., the sputtering process, and a silicon coating 10 having a thickness of 0.1–0.5 μm is similarly formed on the titanium coating 9, thereby forming a two-layer intermediate metal coating.

Thereafter, a hard carbon coating 11 having a thickness of 1.0–3.0 μm is formed on the above silicon coating 10 according to a dry plating process, e.g., the same RFP-CVD process as described above with respect to the hard carbon coating-clad base material shown in FIG. 1.

Thus, a highly reliable hard carbon coating 11 which is excellent in corrosion resistance, adhesion and abrasion resistance is obtained on a base material 6 having poor corrosion resistance, such as brass.

Even if the base material is composed of a metal suffering from softening or the like by temperature elevation, such as brass, a hard carbon coating-clad base material having the same hardness as that of the above base material obtained by subjecting the nickel-phosphorus alloy coating to an aging treatment and then successively superimposing thereon the titanium, silicon and hard carbon coatings by the dry plating process, can be obtained by first forming a nickel-phosphorus alloy coating on the base material with nickel-phosphorus plating, secondly forming a chromium coating on the nickel-phosphorus alloy coating according to a wet plating process without performing an aging treatment, and then successively forming silicon and hard carbon coatings on the chromium coating according to a dry plating process.

When titanium, silicon and hard carbon coatings are successively formed on a base material of SK steel according to a dry plating process, not only does corrosion occur after the pre-wash step but also tiny peelings are observed on the hard carbon coating after the formation thereof by the use of a metallurgical microscope. By contrast, in the hard carbon coating-clad base material of the present invention as shown in FIGS. 1 and 2, no tiny peelings are observed at all by virtue of the possession of the substratal metal coating.

When titanium, silicon and hard carbon coatings are successively formed on a base material of brass according to a dry plating process, the adhesion between the base material and the hard carbon coating is poor due to dezincing from the brass base material, thereby lowering the corrosion resistance of the hard carbon coating. By contrast, in the hard carbon coating-clad base material of the present invention as shown in FIGS. 1 and 2, the hard carbon coating has excellent adhesion and corrosion resistance.

Figure 3:
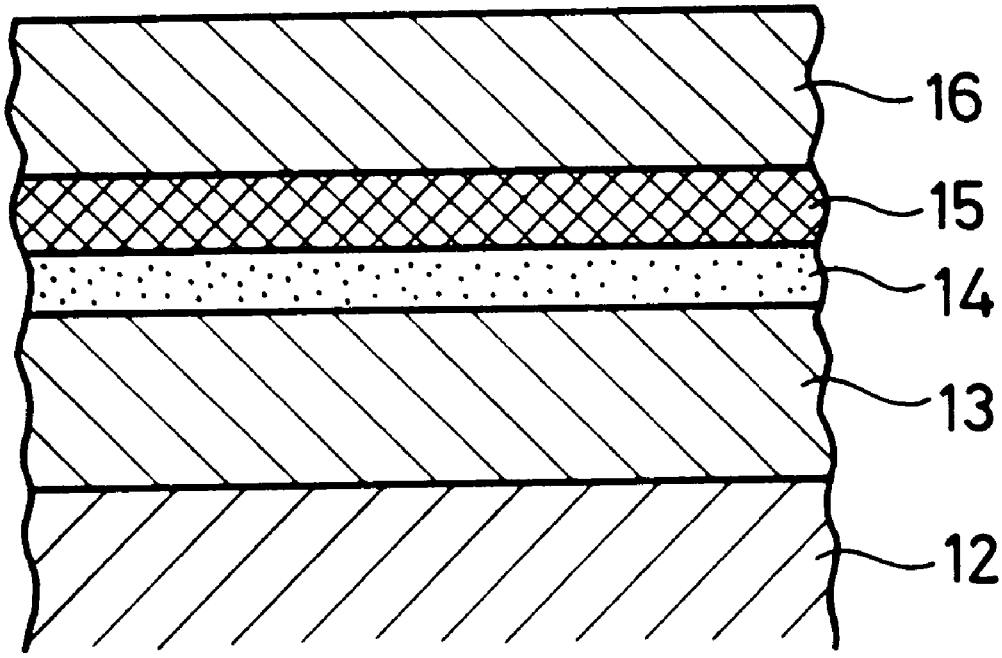
FIG. 3 is a view showing a cross section of an essential portion of still another preferred feature of the hard carbon coating-clad base material according to the present invention.

FIG. 3 is a view showing a cross section of an essential portion of still another preferred feature of the hard carbon coating-clad base material according to the present invention. As shown in FIG. 3, the hard carbon coating-clad base material comprises a base material 12 having poor corrosion resistance, a substratal metal coating composed of a nickel alloy coating 13 formed on the base material 12 by a wet plating process, a two-layer intermediate metal coating composed of a chromium coating 14 formed on the nickel alloy coating 13 by a dry plating process and a silicon coating 15 formed on the chromium coating 14 by a dry plating process, and a hard carbon coating 16.

Examples of base materials 12 having poor corrosion resistance include those as set out above with respect to the hard carbon coating-clad base material shown in FIG. 1, such as brass and SK steel.

For example, a substratal metal coating of a nickel-phosphorus alloy plating having a thickness of 0.5 to 5 μm is formed on a base material of SK steel by the same wet plating process, preferably a nickel plating process, for instance, an electroless nickel-phosphorus plating process, as described above with respect to the hard carbon coating-clad base material shown in FIG. 1, followed by aging treatment.

Subsequently, a chromium coating 14 having a hardness higher than that of a titanium coating, having a thickness of 0.5–1 μm is formed on the nickel-phosphorus alloy coating by a dry plating process, and a silicon coating 15 having a thickness of 0.1–0.5 μm is similarly formed on the chromium coating 14, thereby forming a two-layer intermediate metal coating.

Thereafter, a hard carbon coating 16 having a thickness of 1.0–3.0 μm is formed on the above silicon coating 15 according to a dry plating process, e.g., the same RFP-CVD process as described above with respect to the hard carbon coating-clad base material shown in FIG. 1.

Thus, the highly reliable hard carbon coating 16 which is excellent in corrosion resistance, adhesion and abrasion resistance is obtained on the base material of SK steel 12.

EXAMPLES

The present invention is further illustrated by the following Examples, but the invention is in no way restricted to those examples.

Example 1

First, a nickel-phosphorus alloy coating having a thickness of 0.5–1.0 μm was formed as a substratal metal coating on a base material of SK steel having a length of 20 mm, a width of 25 mm and a thickness of 1 mm by an electroless nickel-phosphorus plating. This plating was performed in a plating bath having the following composition under the following plating conditions.

| [Nickel-phosphorus alloy plating] | |
|---|---|
| {Composition of plating bath} | |
| nickel sulfate | 20 g/liter |
| sodium hypophosphite | 25 g/liter |
| lactic acid | 25 g/liter |
| propionic acid | 3 g/liter |
| {Plating conditions} | |
| pH | 4–5 |
| temperature | 90° C. |

Subsequently, a titanium coating having a thickness of 0.1 μm was formed on the nickel-phosphorus alloy coating by the sputtering process, and a silicon coating having a thickness of 0.3 μm was similarly formed on the titanium coating, thereby forming a two-layer intermediate metal coating.

Thereafter, a hard carbon coating having a thickness of 2 μm was formed on the above silicon coating according to the RFP-CVD process under the following conditions, thereby obtaining a hard carbon coating-clad base material having a structure shown in FIG. 1.

| [Hard carbon coating] | |
|---|---|
| {Conditions for coating formation} | |
| type of gas | methane gas |
| pressure for coating formation | 0.1 Torr |
| high frequency power | 300 watt |
| rate of coating formation | 0.12 $\mu$m/min |
| Vickers hardness (Hv) | 3000–5000 Nkgf/mm$^2$ |

The thus obtained hard carbon coating-clad base material was subjected to Copper Accelerated Acetic Acid Salt Spray test (CASS test), artificial sweat immersion test and abrasion resistance test, which were carried out in the following manners.

(1) CASS Test

This was performed in accordance with the JIS H 8502 Standards.

(Composition of Testing Liquid)

| | |
|---|---|
| NaCl | 50 g/liter |
| CuCl | 0.26 g/liter |
| $CH_3COOH$ | 2 ml/liter |

(Testing Conditions)

| | |
|---|---|
| pH | 3.0 ± 0.1 |
| temperature | 50° C. ± 1° C. |
| time | 24 hours |
| atomizing pressure | 1 kg/cm$^2$ |
| alomizing amount | 1.5 cc/Hr/80 cm$^2$ |

(2) Artificial Sweat Immersion Test (Composition Liquid)

| | |
|---|---|
| NaCl | 9.9 g/liter |
| $Na_2SH_2O$ | 0.8 g/liter |
| $(NH_2)_2CO$ | 1.7 g/liter |
| $(Ch_3CHCOH)CCOH$ | 1.7 ml/liter |
| $NH_4OH$ | 0.2 ml/liter |
| $C_{12}H_{22}O_{11}$ | 0.2 g/liter |

(Testing Conditions)

| | |
|---|---|
| pH | 3.6 ± 0.1 |
| temperature | 40° C. ± 1° C. |
| time | 24 hours |

(3) Abrasion Resistance Test

This was performed using Suga Abrasion Tester manufactured by Suga Tester Co., Ltd.

(Testing Conditions)

| | |
|---|---|
| load | 3 kgf |
| abrasive paper | sic # 600 |
| abrasion cycles | 1600 strokes |

In this Example, neither peeling nor corrosion was observed in the CASS and artificial sweat immersion tests.

The abrasion loss was 0.15 mg in the abrasion resistance test.

As apparent from the above, in this Example, a highly reliable hard carbon coating-clad base material which was excellent in corrosion resistance, adhesion and abrasion resistance was obtained.

Comparative Example 1

A hard carbon coating-clad base material was obtained in the same manner as in Example 1, except that the nickel-phosphorus alloy coating as the substratal metal coating was not formed on the base material of SK steel.

The thus obtained hard carbon coating-clad base material was subjected to the above CASS and artificial sweat immersion tests, in which corrosion was observed.

In this Comparative Example, corrosion occurred after the pre-wash step, and tiny peelings were observed on the hard carbon coating after the formation thereof by the use of a metallurgical microscope.

Comparative Example 2

A hard carbon coating-clad base material was obtained in the same manner as in Comparative Example 1, except that a base material of brass was used in place of the base material of SK steel.

The thus obtained hard carbon coating-clad base material was subjected to the above CASS and artificial sweat immersion tests, in which corrosion was observed.

In this Comparative Example, the adhesion between the base material and the hard carbon coating was poor due to dezincing from the brass base material, thereby lowering the corrosion resistance of the hard carbon coating.

Example 2

A hard carbon coating-clad base material having a structure as shown in FIG. 1 was obtained in the same manner as in Example 1, except that, after the formation of the nickel-phosphorus alloy coating, an aging treatment was conducted at 400° C. for 60 minutes in non-oxidizing furnace, followed by the formation of the titanium coating.

The hardness of the above aged nickel-phosphorus alloy coating per se was 900 Nkgf/mm$^2$ in terms of Vickers hardness (Hv), demonstrating that the aging treatment increased the hardness of the nickel-phosphorus alloy coating per se. In this connection, the hardness of the nickel-phosphorus alloy coating per se before the aging treatment was 350–400 Nkgf/mm$^2$ in terms of Vickers hardness (Hv).

The thus obtained hard carbon coating-clad base material was subjected to the above CASS and artificial sweat immersion tests. In this Example, neither peeling nor corrosion was observed in the tests.

Further, the abrasion resistance test was performed, thereby finding that the abrasion loss was less than 0.1 mg.

As apparent from the above, in this Example, a highly reliable hard carbon coating-clad base material which was excellent in corrosion resistance, adhesion and abrasion resistance was obtained.

Example 3

First, a nickel-phosphorus alloy coating having a thickness of 0.5–1.0 μm was formed on a base material of brass having a length of 20 mm, a width of 25 mm and a thickness of 1 mm by the electroless nickel-phosphorus plating in the same manner as in Example 1.

Subsequently, a chromium coating having a thickness of 0.5 μm as another layer of the substratal metal coating was formed on the nickel-phosphorus alloy coating by a wet plating process. The wet plating was performed in a plating bath having the following composition under the following plating conditions.

| [Chromium plating] | | |
|---|---|---|
| {Composition of plating } | | |
| chromic anhydride | 240–270 | g/liter |
| sulfuric acid | 2–3 | g/liter |
| trivalent chromium | 3–4 | g/liter |
| {Plating conditions} | | |
| bath temperature | 40–55° C. | |
| current density | 30–40 A/dm$^2$ | |

Then, a titanium coating having a thickness of 0.1 μm was formed on the chromium coating by the sputtering process, and a silicon coating having a thickness of 0.3 μm was similarly formed on the titanium coating, thereby forming a two-layer intermediate metal coating.

Thereafter, a hard carbon coating having a thickness of 2 μm was formed on the above silicon coating according to the same RFP-CVD process as in Example 1, thereby obtaining a hard carbon coating-clad base material having a structure shown in FIG. 2.

The thus obtained hard carbon coating-clad base material was subjected to the above CASS and artificial sweat immersion tests. In this Example, neither peeling nor corrosion was observed in the tests.

Further, the abrasion resistance test was performed, thereby finding that the abrasion loss was less than 0.1 mg.

As apparent from the above, in this Example, a highly reliable hard carbon coating-clad base material which was excellent in corrosion resistance, adhesion and abrasion resistance was obtained.

Comparative Example 3

A hard carbon coating-clad base material was obtained in the same manner as in Example 3, except that the nickel-phosphorus alloy coating and the chromium coating were not formed on the base material of brass.

In this Comparative Example, the adhesion between the base material and the hard carbon coating was poor due to dezincing from the brass base material, thereby lowering the corrosion resistance of the hard carbon coating.

Comparative Example 4

A hard carbon coating-clad base material was obtained in the same manner as in Comparative Example 3, except that a base material of SK steel was used in place of the base material of brass.

In this Comparative Example, corrosion occurred after the pre-wash step, and tiny peelings were observed on the hard carbon coating after the formation thereof by the use of a metallurgical microscope.

Example 4

A hard carbon coating-clad base material having a structure as shown in FIG. 2 was obtained in the same manner as in Example 3, except that, after the formation of the nickel-phosphorus alloy coating, an aging treatment was conducted at 400° C. for 60 minutes, followed by the formation of the chromium coating by the wet plating process.

The thus obtained hard carbon coating-clad base material was subjected to the above CASS and artificial sweat immersion tests. In this Example, neither peeling nor corrosion was observed in the tests.

Further, the abrasion resistance test was performed, thereby finding that the abrasion loss was less than 0.1 mg.

As apparent from the above, in this Example, a highly reliable hard carbon coating-clad base material which was excellent in corrosion resistance, adhesion and abrasion resistance was obtained.

Example 5

A hard carbon coating-clad base material having a structure shown in FIG. 1 was obtained in the same manner as in Example 1, except that a base material of brass was used in place of the base material of SK steel.

The thus obtained hard carbon coating-clad base material was subjected to the abrasion resistance test. The adhesion was not satisfactory and peeling was partially observed between the base material of brass and the nickel-phosphorus alloy coating. However, the adhesion of this Example in which the nickel-phosphorus alloy coating was provided was superior to that of Comparative Example 2 in which the nickel-phosphorus alloy coating was not provided.

Further, the CASS and artificial sweat immersion tests were performed, thereby finding that the corrosion resistance of this Example was superior to that of Comparative Example 2.

Example 6

A hard carbon coating-clad base material having a structure as shown in FIG. 1 was obtained in the same manner as in Example 1, except that a base material of brass was used in place of the base material of SK steel, and that, after the formation of the nickel-phosphorus alloy coating on the base material of brass, the nickel-phosphorus alloy coating was subjected to an aging treatment at 400° C. for 60 minutes, followed by the formation of the titanium coating.

The thus obtained hard carbon coating-clad base material was subjected to the above CASS and artificial sweat immersion tests. In this Example, neither peeling nor corrosion was observed in the tests.

Further, the abrasion resistance test was performed, thereby finding that the abrasion loss was less than 0.1 mg.

It is apparent that the adhesion is greater in this Example in which the aging treatment was performed than in Example 5 in which no aging treatment was performed, Thus, in this Example, a highly reliable hard carbon coating-clad base material which was excellent in corrosion resistance, adhesion and abrasion resistance was obtained.

Example 7

First, a nickel-phosphorus alloy coating having a thickness of 0.5–1.0 μm was formed as a substratal metal coating on a base material of SK steel having a length of 20 mm, a width of 25 mm and a thickness of 1 mm by the electroless nickel-phosphorus plating in the same manner as in Example 1, followed by an aging treatment at 400° C. for 60 minutes.

Subsequently, a chromium coating having a thickness of 0.2 μm was formed on the nickel-phosphorus alloy coating by the sputtering process, and a silicon coating having a thickness of 0.3 μm was similarly formed on the chromium coating, thereby forming a two-layer intermediate metal coating.

Thereafter, a hard carbon coating having a thickness of 2 μm was formed on the above silicon coating according to the same RFP-CVD process as in Example 1, thereby obtaining a hard carbon coating-clad base material having a structure shown in FIG. 3.

The thus obtained hard carbon coating-clad base material was subjected to the above CASS and artificial sweat immersion tests. In this Example, none of appearance changes, such as peeling and corrosion, was observed in the tests.

Further, the abrasion resistance test was performed, thereby finding that the abrasion loss was less than 1 mg.

It is apparent that the abrasion resistance of the hard carbon coating of this Example in which the intermediate metal coating formed on the substratal metal coating was comprised of the chromium and silicon coatings is as large as about 1.5 times that of the hard carbon coating of Example 1 in which the intermediate metal coating formed on the substratal metal coating was comprised of the titanium and silicon coatings.

Thus, in this Example, a highly reliable hard carbon coating-clad base material which was excellent in corrosion resistance, adhesion and abrasion resistance was obtained.

Comparative Example 5

A hard carbon coating-clad base material having a structure shown in FIG. 3 was obtained in the same manner as in Example 5, except that the chromium coating as the intermediate metal coating was formed on the nickel-phosphorus alloy coating by the same wet plating process as in Example 3.

The adhesion between the chromium coating and the silicon coating was poor on the thus obtained hard carbon coating-clad base material.

From a comparison of the results of this Comparative Example to those of Example 5, it is apparent that it is important to carry out the formation of the chromium coating as the intermediate metal coating by the dry plating process. Illustratively stated, in the wet plating process, an oxide is formed on the surface of the chromium coating to thereby cause the adhesion between the chromium coating and the silicon coating to become poor. By contrast, when the formation of the chromium coating as the intermediate metal coating is performed by the dry plating process, the chromium and silicon coatings can be formed in the same batch in a vacuum atmosphere. Moreover, the above oxide formation does not occur, so that the adhesion between the chromium and silicon coatings is markedly excellent.

EFFECT OF THE INVENTION

The hard carbon coating-clad base material of the present invention comprises a base material, a substratal metal coating formed on the base material by a wet plating process, an intermediate metal coating comprising a titanium or chromium coating formed on the substratal metal coating by a dry plating process and a silicon coating formed on the titanium or chromium coating by a dry plating process, and a hard carbon coating formed on the silicon coating by a dry plating process. According to the present invention, a highly reliable hard carbon coating which is excellent in corrosion resistance, adhesion and abrasion resistance can be formed even on an iron base material having poor corrosion resistance, such as brass, SK steel and martensitic and ferritic stainless steels.

In particular, the abrasion resistance of the hard carbon coating is especially excellent in a hard carbon coating-clad base material in which the substratal metal coating of a nickel-phosphorus alloy coating has been subjected to an aging treatment and a hard carbon coating-clad base material in which the intermediate metal coating is composed of a chromium coating and a silicon coating. In the case of a base material, such as brass, with which the aging treatment of the nickel-phosphorus alloy coating cannot exhibit satisfactory effect, a hard carbon coating-clad base material having excellent abrasion resistance can be obtained by forming a chromium coating as the substratal metal coating on the nickel phosphorus alloy coating by a wet plating process in place of the aging treatment.

As apparent from the foregoing, the hard carbon coating-clad base material of the present invention has a great advantage in that the scope of the types of available base materials is increased over the prior art to thereby broaden the fields of application of the hard carbon coating.

What is claimed is:

1. A hard carbon coating-clad material comprising:

a base material of steel;

a substratal metal coating deposited by a wet plating process on the steel base material, wherein said substratal metal is selected from the group consisting of (i) nickel, (ii) a nickel alloy, (iii) chromium, (iv) palladium and (v) palladium with nickel or a nickel alloy;

an intermediate metal coating formed on the substratal metal coating, said intermediate metal coating comprising a titanium coating formed on the substratal coating by a dry plating process and including a silicon coating formed on said titanium coating; and a hard carbon coating formed on the silicon coating by a dry plating process.

2. A hard carbon coating-clad material comprising:

a base material of steel;

a substratal metal coating deposited by a wet plating process on the steel base material, wherein said substratal metal is selected from the group consisting of (i) nickel, (ii) a nickel alloy, (iii) chromium, (iv) palladium, (v) palladium with nickel or a nickel alloy and (vi) chromium with nickel or a nickel alloy;

an intermediate metal coating formed on the substratal metal coating, said intermediate metal coating comprising a chromium coating formed on the substratal coating by a dry plating process and including a silicon coating formed on said chromium coating; and a hard carbon coating formed on the silicon coating by a dry plating process.

* * * * *

UNITED STATES PATENT AND TRADEMARK OFFICE

CERTIFICATE OF CORRECTION

PATENT NO. : 6,180,263 B1
DATED : January 30, 2001
INVENTOR(S) : Koichi Naoi

It is certified that error appears in the above-identified patent and that said Letters Patent is hereby corrected as shown below:

Column 1,
Line 26, "Frecuency" should read -- Frequency --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*